US011413650B2

(12) United States Patent
Zahlen et al.

(10) Patent No.: US 11,413,650 B2
(45) Date of Patent: Aug. 16, 2022

(54) LACQUER TRANSFER DEVICE

(71) Applicants: Airbus Operations GmbH, Hamburg (DE); Airbus (S.A.S.), Blagnac (FR)

(72) Inventors: Pierre C. Zahlen, Hamburg (DE); Alexander Gillessen, Hamburg (DE); Sebastian Kerger, Hamburg (DE); Christian Schepp, Königsbrunn (DE); Daniel Kress, Augsburg (DE); Waldemar Kümmel, Maisach (DE)

(73) Assignees: Airbus Operations GmbH, Hamburg (DE); Airbus (S.A.S.), Blagnac (FR)

( * ) Notice: Subject to any disclaimer, the term of this patent is extended or adjusted under 35 U.S.C. 154(b) by 64 days.

(21) Appl. No.: 16/843,112

(22) Filed: Apr. 8, 2020

(65) Prior Publication Data

US 2020/0324315 A1 Oct. 15, 2020

(30) Foreign Application Priority Data

Apr. 11, 2019 (DE) ..... 10 2019 109 580.8

(51) Int. Cl.
*B05C 1/08* (2006.01)
*B05C 5/02* (2006.01)
(Continued)

(52) U.S. Cl.
CPC ..... *B05D 1/28* (2013.01); *B05C 1/027* (2013.01); *B05C 1/08* (2013.01); *B05C 1/0808* (2013.01); *B05C 1/0813* (2013.01); *B05C 5/0254* (2013.01)

(58) Field of Classification Search
None
See application file for complete search history.

(56) References Cited

U.S. PATENT DOCUMENTS 2,218,112 A * 10/1940 Kaufmann ..... B05C 1/027 118/249
3,962,025 A * 6/1976 Jacobson ..... B05C 1/08 156/546
(Continued)

FOREIGN PATENT DOCUMENTS

CN 102 463 293 A 5/2012
DE 34 19 867 C1 9/1985
(Continued)

OTHER PUBLICATIONS

Non-Final Office Action for U.S. Appl. No. 16/829,914 dated Jul. 21, 2021.
(Continued)

*Primary Examiner* — Jethro M. Pence
(74) *Attorney, Agent, or Firm* — Jenkins, Wilson, Taylor & Hunt, P.A.

(57) ABSTRACT

A device for a lacquer transfer includes a frame, transfer roller with a circumferential lateral wall, drive unit for rotating the transfer roller, and slit nozzle with a muzzle end for dispensing lacquer. The slit nozzle includes a first nozzle-part, second nozzle-part and deformation unit. The deformation unit is attached to the first nozzle-part, the lateral wall passing in a rotation direction subsequently the deformation unit and the muzzle end during transfer unit rotation. The lateral wall of the transfer roller is deformed by the deformation unit in the radial direction resulting in a deformation section of the lateral wall in the rotation direction behind the deformation unit, the muzzle end of the slit nozzle arranged for dispensing lacquer into depressions of the lateral wall. The transfer roller can roll with the outside contact surface on a work surface of a work piece for transferring lacquer from the depressions to the work surface of the work piece.

19 Claims, 3 Drawing Sheets

(51) Int. Cl.
*B05D 1/28* (2006.01)
*B05C 1/02* (2006.01)

(56) References Cited

U.S. PATENT DOCUMENTS

| | | | | |
|---|---|---|---|---|
| 4,885,187 | A | 12/1989 | Koenig | |
| 4,974,532 | A | 12/1990 | March | |
| 5,107,788 | A * | 4/1992 | Boldrini | B05C 1/08 118/212 |
| 5,126,529 | A | 6/1992 | Weiss et al. | |
| 5,154,797 | A | 10/1992 | Blomquist et al. | |
| 5,425,848 | A | 6/1995 | Haisma et al. | |
| 6,174,567 | B1 | 1/2001 | Ueberschar et al. | |
| 6,344,088 | B1 | 2/2002 | Kamkihara et al. | |
| 6,554,900 | B1 | 4/2003 | Aydin et al. | |
| 6,627,262 | B1 | 9/2003 | Soas et al. | |
| 9,808,823 | B2 | 11/2017 | Pagendarm et al. | |
| 10,173,238 | B2 | 1/2019 | Sturm et al. | |
| 10,335,824 | B2 | 7/2019 | Mueller | |
| 11,241,708 | B2 | 2/2022 | Zahlen et al. | |
| 11,267,014 | B2 | 3/2022 | Zahlen et al. | |
| 2001/0032585 | A1 | 10/2001 | Koehn et al. | |
| 2002/0108635 | A1 | 8/2002 | Marrero | |
| 2005/0061655 | A1 | 3/2005 | Gros et al. | |
| 2006/0066703 | A1 | 3/2006 | Kadomatsu et al. | |
| 2010/0080958 | A1 | 4/2010 | Goelling | |
| 2010/0233354 | A1 | 9/2010 | Barral et al. | |
| 2012/0148727 | A1 | 6/2012 | Heo et al. | |
| 2012/0313274 | A1 | 12/2012 | Loukusa et al. | |
| 2013/0341497 | A1 | 12/2013 | Zuardy et al. | |
| 2014/0305583 | A1 | 10/2014 | Casset | |
| 2015/0064389 | A1 | 3/2015 | Zahlen et al. | |
| 2015/0251409 | A1 | 9/2015 | Ohnishi | |
| 2015/0273762 | A1 | 10/2015 | Okamoto | |
| 2016/0045927 | A1* | 2/2016 | Svec | B05C 1/0813 427/207.1 |
| 2017/0080454 | A1 | 3/2017 | Hidaka et al. | |
| 2017/0095831 | A1 | 4/2017 | Sturm et al. | |
| 2017/0266691 | A1 | 9/2017 | Travis | |
| 2018/0281297 | A1 | 10/2018 | Pringle et al. | |
| 2020/0032431 | A1 | 10/2020 | Zahlen et al. | |
| 2020/0306785 | A1 | 10/2020 | Zahlen et al. | |
| 2020/0306786 | A1 | 10/2020 | Zahlen et al. | |
| 2020/0306787 | A1 | 10/2020 | Zahlen et al. | |
| 2020/0306791 | A1 | 10/2020 | Zahlen et al. | |
| 2020/0353498 | A1 | 11/2020 | Kerger et al. | |

FOREIGN PATENT DOCUMENTS

| | | | |
|---|---|---|---|
| DE | 37 21 593 | A1 | 1/1989 |
| DE | 694 05 451 | T2 | 3/1998 |
| DE | 699 10 430 | T2 | 3/2004 |
| DE | 699 24 956 | T2 | 9/2005 |
| DE | 10 2014 104 340 | A1 | 10/2015 |
| DE | 10 2014 015 622 | A1 | 4/2016 |
| DE | 20 2016 101 299 | U1 | 6/2017 |
| DE | 10 2016 224 592 | A1 | 6/2018 |
| EP | 0 408 283 | A2 | 1/1991 |
| EP | 1 034 905 | A2 | 9/2000 |
| EP | 1 117 488 | B1 | 5/2004 |
| EP | 2 021 180 | B1 | 11/2011 |
| EP | 3 248 692 | A1 | 11/2017 |
| EP | 3 263 447 | A1 | 1/2018 |
| EP | 2 632 605 | B1 | 5/2019 |
| EP | 3 722 007 | A1 | 10/2020 |
| EP | 3 722 009 | A1 | 10/2020 |
| EP | 3 725 422 | A1 | 10/2020 |
| EP | 3 725 539 | A1 | 10/2020 |
| EP | 3 733 300 | A1 | 11/2020 |
| EP | 3 750 637 | A1 | 12/2020 |
| GB | 1 555 771 | A | 11/1979 |
| JP | S60250936 | A | 12/1985 |
| JP | S63274748 | A | 11/1988 |
| JP | 2005-034740 | A | 2/2005 |
| JP | 2006-026558 | A | 2/2006 |
| JP | 2008-086882 | A | 4/2008 |
| KR | 2001/0093377 | A | 10/2001 |
| TW | 2011 03647 | A | 2/2011 |
| WO | WO 89/11343 | A2 | 11/1989 |
| WO | WO 99/60210 | A1 | 11/1999 |
| WO | WO 02/026399 | A1 | 4/2002 |
| WO | WO 2010/146998 | A1 | 12/2010 |
| WO | WO 2015/064685 | A1 | 5/2015 |
| WO | WO 2015/155128 | A1 | 10/2015 |
| WO | WO 2018/150190 | A1 | 8/2018 |

OTHER PUBLICATIONS

Non-Final Office Action for U.S. Appl. No. 16/829,925 dated Sep. 1, 2021.
European Search Report for Application No. 20164755.9 dated Sep. 15, 2020.
European Search Report for Application No. 20164573.6 dated Sep. 15, 2020,.
European Search Report for Application No. 20164756.7 dated Sep. 21, 2020.
European Search Report for Application No. 20168066.7 dated Sep. 22, 2020.
European Search Report for Application No. 20166215.2 dated Sep. 7, 2020.
European Search Report for Application No. 20164300.4 dated Sep. 29, 2020.
Non-Final Office Action for U.S. Appl. No. 16/644,132 dated May 13, 2021.
Non-Final Office Action for U.S. Appl. No. 16/829,898 dated Jun. 9, 2021.
Restriction Requirement for U.S. Appl. No. 16/829,880 dated Oct. 1, 2021.
Notice of Allowance for U.S. Appl. No. 16/844,132 dated Oct. 4, 2021.
Corrected Notice of Allowance for U.S. Appl. No. 16/844,132 dated Oct. 15, 2021.
Final Office Action for U.S. Appl. No. 16/829,914 dated Nov. 9, 2021.
Notice of Allowance for U.S. Appl. No. 16/829,898 dated Nov. 19, 2021.
Corrected Notice of Allowance for U.S. Appl. No. 16/844,132 dated Dec. 8, 2021.
Corrected Notice of Allowance for U.S. Appl. No. 16/829,898 dated Dec. 13, 2021.
Notice of Allowance for U.S. Appl. No. 16/829,914 dated Jan. 20, 2022.
Notice of Allowance for U.S. Appl. No. 16/829,925 dated Mar. 4, 2022.
Non-Final Office Action for U.S. Appl. No. 16/829,880 dated Mar. 15, 2022.

* cited by examiner

LACQUER TRANSFER DEVICE

CROSS-REFERENCE TO RELATED APPLICATION

This application claims priority to German Patent Application No. 10 2019 109 580.8 filed Apr. 11, 2019, the entire disclosure of which is incorporated by reference herein.

TECHNICAL FIELD

The disclosure herein relates to a device for a lacquer transfer.

BACKGROUND

A device for a lacquer transfer is known from the publication WO 2015/155 128 A1. This publication discloses a device which is configured for transferring lacquer to a work surface of a work piece. This device is called an applicator. The device comprises a frame, a transfer roller with a circumferential lateral wall and a drive unit. The outside contact surface of the lateral wall comprises several depressions. The drive unit is configured for a circumferential movement of the transfer roller. The transfer roller is mounted rotatably about an axis of rotation at the frame. The device can be connected to a robot arm of a robot and can be moved via the robot in parallel to the work surface of the work piece, such that the transfer roller roles with its contact surface on the work surface for transferring lacquer from the depressions in the lateral wall of the transfer roller to the work surface. Before the contact surface of the circumferential lateral wall of the transfer roller comes into contact with the work surface, the depressions of the lateral wall have to be filled with the lacquer, such that the lacquer can be transferred subsequently to the work surface while the transfer rollers roles on this work surface.

When transferring lacquer via the device to a work surface of a work piece, an object is to transfer a desired or predetermined amount of a lacquer to the work surface. Therefore, the depressions of the lateral wall of the transfer roller have to be previously filled with the respective amount of lacquer. For filling the depressions with lacquer, a lacquer supply unit should be ranged close to the lateral wall of the transfer roller.

During an inspection of the use of a device as known from the prior art, it has been found that the depressions can be filled with lacquer, if the lacquer supply unit is as closed as possible arranged to the circumferential lateral wall of the transfer roller. However, it has also been found that the radius of the circumferential lateral wall of the transfer roller is in practice often not evenly constant about the circumference of the transfer roller. Instead, it is not unusual that the radius of the circumferential lateral wall varies over the circumference of the transfer roller. During rotation of the transfer roller, a radial distance between the lacquer supply unit and the circumferential lateral wall may also vary. Depending on the variance of this radial distance, the depressions may be fully filled with lacquer or just partly. It may also occur that the lacquer supply unit hits the circumferential lateral wall while the transfer roller rotates, if a section of the circumferential lateral wall has a larger radius than the remaining lateral wall. This may cause a temporary interruption of the rotation of the transfer roller. This is also referred to as a slip-stick-effect. The slip-stick-effect has a negative impact for the dispensing of the lacquer into the depressions and/or onto the outside surface of the lateral wall of the transfer roller. Therefore, the slip-stick-effect between the slit nozzle and the transfer roller is to be prevented.

SUMMARY

An object of the disclosure herein is to provide a device which is configured for transferring a lacquer via a transfer roller to a work surface of a work piece, such that a slip-stick-effect between the transfer roller rolling on the work surface and a lacquer supply unit is prevented.

The object is solved by a device as disclosed herein. Therefore, the disclosure herein relates to a device for a lacquer transfer. The device comprises a frame, a transfer roller with a circumferential lateral wall, a drive unit, and a slit nozzle with a muzzle end for dispensing lacquer. The slit nozzle is at least indirectly connected to the frame. An outside contact surface of the lateral wall comprises several depressions. The transfer roller is mounted rotatably about an axis of rotation at the frame, wherein the drive unit is configured to drive the transfer roller in a rotation direction of the transfer roller. The lateral wall of the transfer roller is elastically deformable in a radial direction of the transfer roller. The slit nozzle comprises a first nozzle-part, a second nozzle-part and a deformation unit. The deformation unit is configured to elastically deform the lateral wall in the radial direction of the transfer roller, wherein the deformation unit is attached to the first nozzle-part, such that the lateral wall passes in rotation direction subsequently the deformation unit and the muzzle end during a rotation of the transfer unit in rotation direction. The slit nozzle is arranged such that the lateral wall of the transfer roller is deformed by the deformation unit in radial direction resulting in a deformation section of the lateral wall in the direction of rotation behind the deformation unit. The muzzle end of the slit nozzle is arranged contactless to or in direct contact with the outside contact surface at the deformation section of the lateral wall for dispensing lacquer into respective depressions. The transfer roller is configured to roll with the outside contact surface on a work surface of a work piece for transferring the lacquer from the depressions to the work surface of the work piece.

Preferably, the device or at least its frame is configured to be releasably connected to a handling device, such as a robot with a robot arm. The frame may be configured to be releasably connected to the robot arm. Thus, the device may be a mobile device, in particular a mobile mechanical device.

The frame may form the basis of the device, since the slit nozzle is at least indirectly connected to the frame. For this purpose, the device may comprise further aa connector(s) for connecting the slit nozzle to the frame. Preferably, the slit nozzle is releasably mounted to the frame. Thus, the slit nozzle may be disconnected from the frame, in particular for a maintenance purpose. The slit nozzle may be connected to the frame, such that the slit nozzle can be releasably locked in a working position. If this lock is released, the slit nozzle may be pivoted via a hinge, which holds the slit nozzle at the frame. Thus, the slit nozzle may then be subject to a maintenance procedure.

The transfer roller comprises a circumferentially extending lateral wall. This wall may be formed by a tire of the transfer roller. The outside contact surface of the lateral wall comprises depressions. The depressions allow a transfer of lacquer. The depressions may be evenly distributed about the outer contact surface. The depressions can be formed by recesses arranged at the outer contact surface. The depressions can have a predefined size and/or structure. A mean structure size of the depressions can be in the range of 0.1 micrometer to 100 micrometer. Each of the depressions can be opened towards a surrounding of the transfer roller in the radial direction and closed towards an interior space of the transfer roller.

The transfer roller is mounted rotatably to the frame, preferably by bearings. The rotatable mounting at the frame of the transfer roller allows the transfer roller to rotate relative to the frame about the axis of rotation. For this purpose, the device comprises the drive unit, which is configured to drive the transfer roller in a rotation direction of the transfer roller about the axis of rotation. The drive unit may also be at least indirectly or directly connected or mounted to the frame. During use, the drive unit drives the transfer roller, such that the transfer roller rotates about the axis of rotation and roles with the contact surface on a work surface. Furthermore, the device is moved translational in parallel to the work surface, preferably by a robot arm or another handling device, while the transfer roller rotates, such that the transfer roller rolls on the work surface for transferring lacquer.

The lateral wall of the transfer roller is elastically deformable in a radial direction of the transfer roller. Therefore, the lateral wall may be made of a material, which can be deformed in radial direction towards the center of the transfer roller, if a force acts on the outside contact surface in radial direction. If this force is withdrawn, the lateral wall of the transfer roller will reform itself. For example, the Young's modulus of the lateral wall of the transfer roller is at most 10 GPa. Preferably, the lateral wall of the transfer roller is made of a plastic. This is preferably of an elastically deformable type. Moreover, the lateral wall of the transfer roller is preferably made of elastomer plastic, such that it can be elastically deformed in a radial direction of the transfer roller.

The slit nozzle comprises a first nozzle-part, a second nozzle-part and a deformation unit. The slit nozzle may be formed only of a first nozzle-part, a second nozzle-part and a deformation unit. But the slit nozzle may alternatively comprise further parts and/or at least one further unit. Preferably, the first nozzle-part and the second nozzle-part are arranged, such that the first nozzle-part is seated on the second nozzle-part. In the direction of the rotation of the transfer roller, the second nozzle-part is preferably arranged behind the first nozzle-part.

The deformation unit is configured to elastically deform the lateral wall in the radial direction of the transfer roller. Therefore, the deformation unit may be configured to apply a force onto the lateral wall of the transfer roller, such that the force acts in radial direction on the lateral wall. This results in the elastic deformation of the lateral wall. The deformation unit may be configured to press directly on the lateral wall. This allows to apply the precise predefined force on the lateral wall and/or allows a precise deformation depth in radial direction of the transfer roller. But the deformation unit may alternatively be configured to apply the force onto the lateral wall without a direct contact between the deformation unit and the lateral wall. This may result in a very low friction between the lateral wall and the deformation unit.

The deformation unit is attached to the first nozzle-part. The first nozzle-part may at least partly form the nozzle channel and/or may form at least a part of the muzzle end of the slit nozzle. The first nozzle-part may therefore extend to an end of the slit nozzle being arranged directly opposite of the transfer roller. This end is preferably referred to as a front end of the first nozzle-part. Moreover, the deformation unit is preferably arranged at the front end of the first nozzle-part and protruding beyond the front end of the first nozzle-part towards the transfer roller.

The deformation unit is attached to the first nozzle-part such that the lateral wall passes in rotation direction subsequently the deformation unit and the muzzle end during a rotation of the transfer unit in rotation direction. Moreover, the deformation unit is preferably arranged by the slit nozzle close to or even in direct contact with the lateral wall of the transfer roller, such that the deformation unit deforms the transfer roller resulting in a deformation section, which is independent of the rotation angle of the transfer roller directly behind the deformation unit in rotation direction of the transfer roller. In other words, the deformation section is stationary with respect to the deformation unit, but not with the transfer roller as such, at least while the transfer roller is rotating. In order to achieve a deformation of the lateral wall of the transfer roller, the slit nozzle is arranged such that the lateral wall of the transfer roller is deformed by the deformation unit in radial direction resulting in the deformation section of the lateral wall arranged in the direction of rotation of the transfer roller behind the deformation unit.

Therefore, when the transfer roller is driven by the drive unit in a rotation direction, the lateral wall of the transfer roller continuously passes (in the rotation direction) the deformation unit, where the lateral wall of the transfer roller is elastically deformed. This results in the deformation section of the lateral wall behind the deformation unit, wherein the lateral wall is elastically deformed in the deformation section. The muzzle end of the slit nozzle is arranged behind (in rotation direction of the transfer roller) the deformation unit, such that the muzzle end of the slit nozzle is always arranged opposite to the deformation section. In other words, the muzzle end of the slit nozzle is arranged contactless to or in direct contact with the outside contact surface at the deformation section of the lateral wall for dispensing lacquer into respective depressions.

The slit nozzle may be connected via a pipe or a tube to a lacquer supply unit, which may be configured to supply the lacquer via the tube or the pipe to the slit nozzle. The lacquer may be a self-hardening lacquer or a lacquer, which can be hardened via UV-light. The lacquer supplied to the slit nozzle may be a liquid medium or a viscous medium.

According to a first nozzle arrangement of the slit nozzle, the muzzle end of the slit nozzle may be arranged contactless to the outside contact surface at the second deformation section of the lateral wall for dispensing lacquer into respective depressions.

According to a second nozzle arrangement of the slit nozzle, the muzzle end of the slit nozzle is arranged in direct contact with the outside contact surface at the second deformation section of the lateral wall for dispensing lacquer into respective depressions.

If reference is subsequently made to the slit nozzle without explicitly specifying the first or second nozzle arrangement, the corresponding explanations may, in principle, apply as preferred embodiments to each of the two arrangements. Therefore, it may be possible to apply the respective explanations to one of the first and second nozzle arrangement or to both nozzle arrangements.

The slit nozzle is configured for dispensing lacquer from the muzzle end into the depressions of the lateral wall of the transfer roller. The slit nozzle may also be configured for dispensing lacquer from the muzzle end onto depression-free sections of the lateral wall of the transfer roller. Thus, the slit nozzle may be configured for dispensing a lacquer film onto the lateral wall of the transfer roller, wherein the lacquer of the lacquer film fills the depressions and the lacquer film extends in axial direction and partly in circumferential direction of the transfer roller. The lacquer film may therefore theoretically divide into a depression part, which fills the depressions, and a remaining part, which is also referred to as bulk or a bulk part. Therefore, the transfer roller may be configured to roll with the contact surface of the transfer roller on a work surface of a work piece for transferring the lacquer from the contact surface to the work surface of the work piece, such that the lacquer film is transferred to the work surface. This encompassed the transfer of the lacquer from the depressions, but also the transfer of the bulk part. If the transfer of the lacquer from the depressions to the work surface, in particular to a surface of a wing, is described in the following, this shall preferably not exclude the possible transfer of the bulk part to the respective surface and/or the possible transfer of the lacquer from the depressions via the lacquer film.

Resulting from a preferred direct contact between the muzzle end of the slit nozzle and the outside surface of the lateral wall of the transfer roller, preferably if the slit nozzle is in the first nozzle arrangement, a desired fill level of the depressions may be ensured and/or a desired mean thickness of the lacquer film may be ensured. However, a resulting contact force and/or a resulting contact friction should not change as much as possible during a rotation of the transfer roller in order to prevent the slip-stick-effect as described in the introduction. In an analogous manner, a slip-stick-effect shall be prevented, if the muzzle end of the slit nozzle is not in direct contact with the lateral wall of the transfer roller.

Thus a desired fill level of the depressions may also be ensured and/or a desired mean thickness of the lacquer film on the outside surface of the lateral wall may be ensured, if the muzzle end of the slit nozzle is arranged contactless to the outside contact surface at the deformation section of the lateral wall, in particular, if the slit nozzle is arranged according to the second nozzle arrangement. A distance formed by the gap between the muzzle end of slit nozzle and the outside contact surface at the deformation section may be predefined by an arrangement of the slit nozzle according to the second nozzle arrangement, such that lacquer dispensed by the slit nozzle continuously forms the lacquer film on the outside surface of the lateral wall, preferably with a predefined thickness. The dispensed lacquer therefore fills the aforementioned gap with the lacquer. As an effect, lacquer also fills the depressions of the outside contact surface at the deformation section of the lateral wall. As a further effect, a bulk part may also be applied to the outside contact surface at the deformation section of the lateral wall.

As described before, the deformation unit is arranged and configured, such that the lateral wall is elastically deformed. As the elastic deformation of the lateral wall does not change abruptly, the elastic deformation of the lateral wall results in the deformation section of the lateral wall directly following the exert-position in rotation direction of the transfer roller, wherein the exert-position is the position, where a deformation force is applied by the deformation unit for deforming the lateral wall of the transfer roller.

In particular while the transfer roller rotates about the axis of rotation, the muzzle end of the slit nozzle is arranged in direct contact with the deformation section of the lateral wall or the muzzle end of the slit nozzle is arranged contactless to the deformation section of the lateral wall. The deformation section results from the elastic deformation of the lateral wall caused by the deformation unit, which is fixed with the frame. Therefore, the deformation section may represent a transition section between the exert-position and an undeformed section of the lateral wall. This undeformed section of the lateral wall may be arranged between the deformation section and a further, third section of the lateral wall, which is located to come into direct contact with the work surface of the workpiece.

In contrast to the often not constant radius of the undeformed section of the lateral wall, the deformation section preferably has an at least substantially predefined orientation and/or an at least substantially predefined course of the respective radius in the rotation direction. A contact angle and/or a contact force and/or a contact friction between the muzzle end of the slit nozzle and the deformation section of the lateral wall of the transfer roller is therefore only subject to a very low variance. This prevents a friction between the transfer roller and the muzzle end of the slit nozzle from unforeseen and/or undesired change between sliding friction and adhesion. Instead, a sliding friction may be ensured. As a result, the previously discussed slip-stick-effect can be prevented.

According to a preferred embodiment of the device, a fluid channel of the slit nozzle extending to the muzzle end is formed by the first nozzle-part and the second nozzle-part of the slit-nozzle. Each of both nozzle-parts may form a section of the fluid channel. But the nozzle-parts may also form opposite surface limiting the fluid channel. Thus, the fluid channel of the slit nozzle extending to the muzzle end may extend between the first nozzle-part and the second nozzle-part of the slit-nozzle. The fluid channel may extend from a connector or fluid cavity of the slit nozzle to the muzzle end, such that the lacquer has to pass the fluid channel before it can be dispensed via the muzzle end. Since both nozzle-parts together preferably form or limit the fluid channel, an effective cross-section may be controlled by a controllable distance between both nozzle-parts.

According to a preferred embodiment of the device, a minimum distance between a deformation surface of the deformation unit facing the lateral wall and the muzzle end is less than 20 mm. In an example, deformation surface of the deformation unit is in direct contact with the lateral wall of the transfer roller. In this case, the deformation surface is directly opposite to the exert-position as explained above. Since the distance between the deformation surface, and the exert-position, and the muzzle end is limited to 20 mm, a precise arrangement of the muzzle end of the slit nozzle opposite to the deformation surface can be achieved, in particular without the fear of a slip-stick effect.

According to a preferred embodiment of the device, the deformation surface of the deformation unit facing the lateral wall and the muzzle end are arranged within an angular range of less than 40 degree about a rotation axis of the transfer roller. Preferably, the angular range is less than 30 degree or less than 20 degree. As the deformation of the lateral wall caused by the deformation unit does not change abruptly in rotation direction, but will decrease with the distance from the exert-position, which is preferably opposite to the deformation surface of the deformation unit, the deformation of the lateral wall opposite to the muzzle end is smaller the further the nozzle is arranged from the deformation unit. Limiting the angular range to one of the above the preferred values can achieve, that the deformation of the lateral wall opposite to the muzzle end is large enough to allow a precise arrangement of the muzzle end opposite to the outside contact surface of the lateral wall without causing a slip-stick effect.

According to a preferred embodiment of the device, the slit nozzle is arranged such that the lateral wall is deformed by the deformation unit by less than 15 mm in radial direction. Preferably, the lateral wall of the transfer roller is deformed by the deformation unit in radial direction between 3 mm and 15 mm. Limiting the maximum deformation limits or reduces the resistance against a rotation of the transfer roller. Limiting the minimum deformation ensures that the deformation section is always achieved, such that the muzzle end of the slit nozzle can be precisely arranged with respect to the lateral wall without causing a slip-stick effect.

According to a preferred embodiment of the device, the deformation unit protrudes at least 1 mm, preferably at least 3 mm, beyond the remaining slit nozzle towards the outside contact surface of the lateral wall. As an effect, the deformation unit prevents that the remaining part comes into direct contact with the lateral wall of the transfer roller. This effectively prevents the slip-stick effect. But the protruding deformation unit can also be a predefined distance between the muzzle end of the slit nozzle and the deformation section of the transfer roller. A desired amount and/or distribution of lacquer dispensed by the slit nozzle on the transfer roller can therefore be achieved.

According to a preferred embodiment of the device, if the muzzle end of the slit nozzle is arranged contactless to the outside contact surface of the lateral wall, the slit nozzle is arranged such that a first minimum distance between the muzzle end facing the outside contact surface and this outside contact surface is less than 15 mm, in particular between 0.01 mm and 10 mm. The first minimum distance allows a good distribution of lacquer when being dispensed from the muzzle end of the slit nozzle on the outside contact surface of the lateral wall of the transfer roller. Preferably, a nozzle channel of the slit nozzle is formed by the first and second nozzle-parts, such that the nozzle channel extends to the muzzle end. As the muzzle end is arranged in the first minimum distance with the outside contact surface of the lateral wall, a slip-stick effect can be prevented.

According to a preferred embodiment of the device, the first nozzle-part is in direct contact with the outside contact surface of the lateral wall, and wherein the second nozzle-part is spaced apart from this outside contact surface. The direct contact between the first nozzle-part and the outside contact surface of the lateral wall allows a precise adjustment of the space between the outside contact surface and the second nozzle-part, as the first and second nozzle-parts are connected and/or mounted with each other.

In case the first nozzle-part is in direct contact with the lateral wall, the contact pressure of the first nozzle-part on the outside contact surface and/or the resulting deformation can still be precisely adjusted by the first nozzle-part.

According to a preferred embodiment of the device, the first nozzle-part protrudes beyond the second nozzle-part in a direction towards the outside contact surface of the lateral wall.

Independent whether the first nozzle-part contacts or does not directly contact the lateral wall, the first nozzle-part may also protrude beyond the second nozzle-part, such that the second nozzle-part is set back in relation to the first nozzle-part from the outside contact surface. As a result, an output channel end between the slit nozzle and the lateral wall for dispensing the lacquer may be defined. This channel end may be allocated to the slit nozzle. Therefore, a film thickness of the lacquer to be applied on the outside contact surface can be precisely adjusted by the second nozzle-part, in particular by the distance the second nozzle-part is set back with respect to the first nozzle-part. This embodiment is of particular advantage, if the second nozzle-part is arranged behind the first nozzle-part in the rotation direction of the transfer roller.

The resulting distance between the second nozzle-part and the outside contact surface forms a thickness of this output channel end and can therefore at least influence the thickness of the applied lacquer. If the second nozzle-part is displaceable and/or adjustable with respect to the first nozzle-part, this may be used to define the thickness of the lacquer film. This may be independent of the contact force and/or deformation resulting from the contact between the first nozzle-part and the outside contact surface, if the first nozzle-part is in contact with the outside surface of the lateral wall.

According to a preferred embodiment of the device, the second nozzle-part is spaced apart from the outside contact surface by a second minimum distance between 0.01 mm and 5 mm, in particular between 1 mm and 3 mm. This allows to precisely adjust the thickness of the lacquer to be applied to the outside contact surface of the transfer roller, in particular in the range between 0.01 mm and 5 mm, for instance between 1 mm and 3 mm.

According to a preferred embodiment of the device, the transfer roller is an inflated transfer roller. Thus, the transfer roller may form a gastight interior space, which is at least partly limited by the circumferential lateral wall of the transfer roller. The interior space may have the form of a torus. The transfer roller may be inflated, such that air or gas in the interior space has a predefined pressure or a controlled pressure. The lateral wall of the transfer roller is elastically deformable in radial direction. This may be allowed by the inflated transfer roller, since the lateral wall can be deformed against the pressure of the air/gas in the interior space. The inner pressure may act on an inner surface of the lateral wall, such that the deformation caused by the deformation unit is reversed within the deformation section.

According to a preferred embodiment of the device, the lateral wall is deformed by the deformation unit between 0.5 mm and 30 mm in radial direction of the transfer roller. The lower limit of 0.5 millimeter may ensure that a possible variance of the radius of the lateral wall of the transfer roller does not have a substantial effect on the preferably predefined orientation and/or preferably predefined course of a radius of the deformation section. The upper limit of 30 millimeter may ensure that the deformation of the lateral wall is limited, in particular such that deformation of the lateral wall remains elastic. This allows a long lifetime of the transfer roller.

According to a preferred embodiment of the device, the deformation unit comprises a pressure roller, which presses rollably on the lateral wall resulting in a deformation of the lateral wall in radial direction. This allows the pressure roller to press rollably on an outside surface, in particular the on contact surface of the lateral wall resulting in a deformation of the lateral wall in a radial direction. The pressure roller has the positive effect of not causing a too high roll friction between the pressure roller and the lateral wall of the transfer roller. The deformation unit may be formed by the pressure roller. The pressure roller may be rotatably mounted to the first nozzle-part, for instance by bearings.

According to a preferred embodiment of the device, the deformation unit comprises a gas pressure unit configured to generate positive gas pressure acting contactless on the lateral wall resulting in a deformation of the lateral wall in radial direction. Thus, the deformation unit with the gas pressure unit can be arranged outside of the lateral wall, such that the gas pressure, which is generated by the gas pressure unit, acts contactless on the outside surface of the lateral wall resulting in a deformation in a radial direction of the lateral wall. The gas pressure unit of the deformation unit has the positive effect that a friction between the deformation unit and the lateral wall can be as small as possible. This helps to prevent a slip-stick-effect as discussed in the introduction.

According to a preferred embodiment of the device, ferromagnetic metal particles are embedded in the lateral wall, and wherein the deformation unit comprises a magnet, in particular a controllable electro-magnet, causing a magnetic force on the metal particles resulting in a deformation of the lateral wall in radial direction. For instance, the ferromagnetic metal particles are distributed evenly in circumferential direction of the lateral wall of the transfer roller. Moreover, the magnet of the deformation unit is preferably a controllable electro-magnet. The electro-magnet can be controlled such that the magnetic force acting on the metal particles embedded in the lateral wall is also controlled. Preferably, the deformation unit is arranged contactless with respect to the lateral wall, as the magnet force does not need a direct contact between the magnet and the metal particles. As an effect, a friction between the deformation unit and the lateral wall can be as small as possible. This helps to prevent a slip-stick-effect as discussed in the introduction.

BRIEF DESCRIPTION OF THE DRAWINGS

Further features, advantages and application possibilities of the disclosure herein may be derived from the following description of example embodiments and/or the figures. Thereby, all described and/or visually depicted features for themselves and/or in any combination may form an advantageous subject matter and/or features of the disclosure herein independent of their combination in the individual claims or their dependencies. Furthermore, in the figures, same reference signs may indicate same or similar objects.

DETAILED DESCRIPTION

Figure 1:
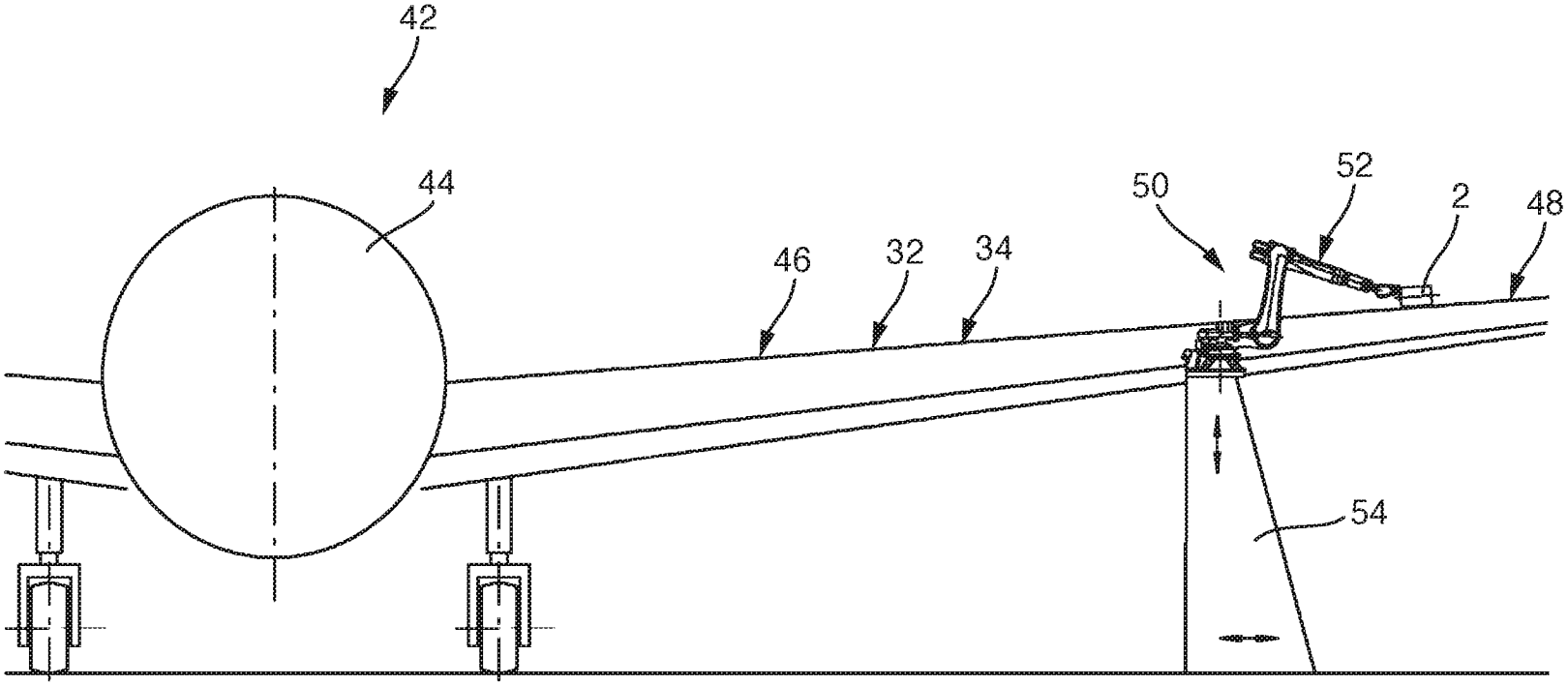
FIG. 1 schematically illustrates a part of an aircraft wherein a device arranged for transferring lacquer on an upper wing surface.

FIG. 1 schematically illustrates an aircraft 42, which comprises a fuselage 44 and a wing 46. The air resistance of the aircraft 42 can be reduced, if the upper wing surface 48 of the wing 46 comprises a profile structure. It has been found of advantage, if this profile structure is a microstructure.

FIG. 1 also schematically shows a robot 50, which is seated on a rack 54. The robot 50 comprises a movable robot arm 52. A device 2 is mounted at an end of the robot arm 52, such that the device 2 can be moved by the robot 50.

The device 2 is configured for transferring a lacquer onto a work surface 32 of a workpiece 34. According to the example shown in FIG. 1, the workpiece 34 can be formed by the wing 46 of the aircraft 42. Thus, the upper wing surface 48 can form the work surface 32.

Figure 2:
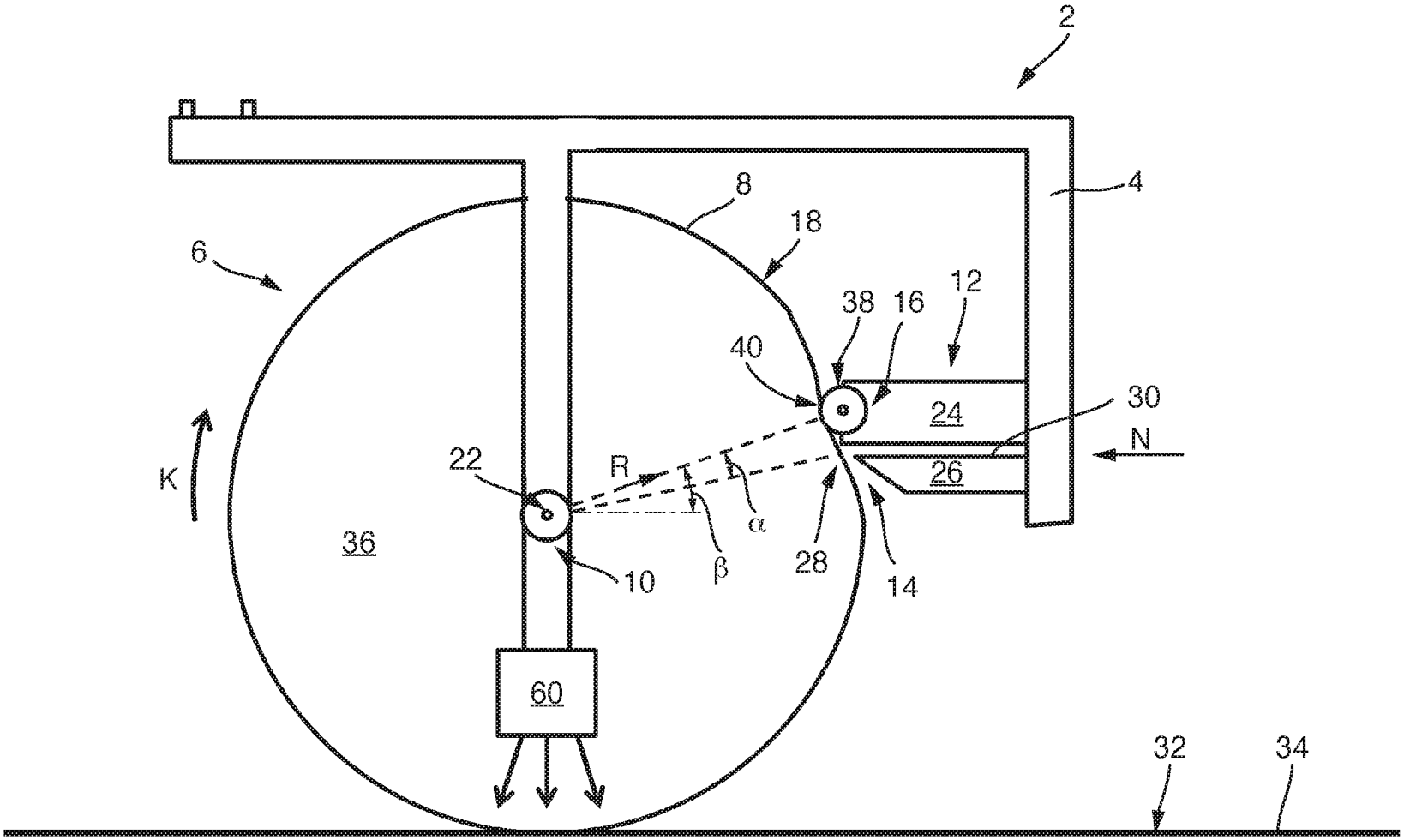
FIG. 2 schematically illustrates an embodiment of the device in a cross-sectional view.

A first embodiment of the device 2 is schematically illustrated in FIG. 2 in a cross-sectional view. The device 2 comprises a frame 4, a transfer roller 6 with a circumferential lateral wall 8, a drive unit 10, a slit nozzle 12 with a muzzle end 14 for dispensing lacquer, and a deformation unit 16. The transfer roller 6 may also be referred to as a transfer tire. The device 2 can be attached via the frame 4 to the robot arm 52. However, instead of a robot 50 any other handling device may also be used, which is configured to move the device 2 in space. The frame 4 may be adapted to be releasably connected to a handling device, such as the robot 50.

The transfer roller 6 is mounted rotatably, in particular by at least one bearing, about an axis of rotation 22 at the frame 4. An outside contact surface 18 of the lateral wall 8 comprises several depressions 20. The depressions 20 may be evenly or stochastically distributed about the circumference of the lateral wall 8. The FIGS. 3 and 4 show a part of the transfer roller 8 in a cross-section view and a top view, respectively.

Figure 3:
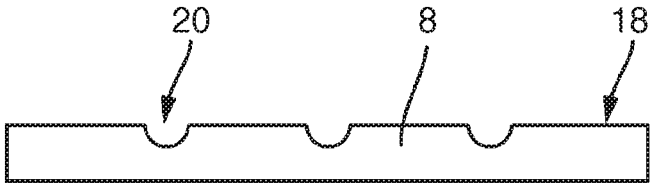
FIG. 3 schematically illustrates a part of the lateral wall of the transfer roller in a cross-sectional view.

As schematically indicated in FIG. 3, the depressions 20 can be formed by recesses arranged at the outside surface 18 of the lateral wall 8 of the transfer roller 6. The depressions 20 can have a predefined size and/or structure. A mean structure size of the depressions 20 can be in the range of 0.1 micrometer to 100 micrometer. In other words, each of the depressions 20 may have a microstructure.

Figure 4:
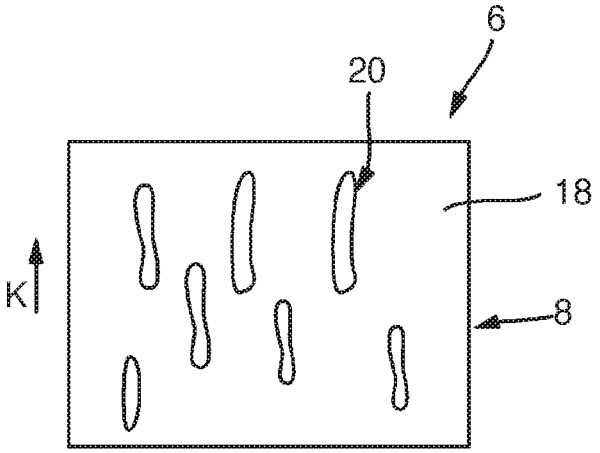
FIG. 4 schematically illustrates a further embodiment of the lateral wall of the transfer roller in a top view.

FIG. 4 as an example shows the depressions 20 of a part of the lateral wall 8 of the transfer roller 6 in a top view. Each of the depressions 20 may comprise an elongated extension in a rotation direction K of the transfer roller 6.

Each of the depressions 20 is configured to receive lacquer and to transfer this received lacquer to a work surface 32 of a work piece 34, such as the upper wing surface 48 of a wing 46. Therefore, the several depressions 20 at the outside contact surface 18 of the lateral wall 8 may be arranged and/or formed according to a predefined structure, in particular a microstructure. The lateral wall 8 is preferably made of silicone, such that a damage of the wing surface 48 can be prevented.

If the depressions 20 are filled with a lacquer and if the outside contact surface 18 comes into contact with the work surface 32, in particular the upper wing surface 48, the lacquer previously received in the depressions 20 is transferred to the work surface 32, in particular the upper outside surface 48 of the aircraft 42. This transferred lacquer has a structure, in particular microstructure, corresponding to a structure defined by depressions 20. Thus, the outside contact surface 18 with its depressions 20 is configured for embossing a lacquer-structure, in particular a lacquer-microstructure, on the work surface 32, in particular the upper wing surface 48.

As schematically illustrated in FIG. 2, the slit nozzle 12 is preferably directly connected to the frame 4. Thus, the slit nozzle 12 may be mounted to the frame 4.

The slit nozzle 12 comprises a first nozzle-part 24 and a second nozzle-part 26. Both parts may be mounted together, such that a fluid channel 30 extending to the muzzle end 14 is formed by the nozzle-parts 24, 26. The deformation unit 16 is allocated and/or mounted with the slit nozzle 12, such that the deformation unit 16 is directly connected to the first nozzle-part 24 of the slit nozzle 12. For instance, the deformation unit 16 may be mounted on the first nozzle-part 24 of the slit nozzle 12, in particular by at least one bearing. According to an example, the slit nozzle 12 and the deformation unit 16 may be formed by an integrated unit. But the deformation unit 16 is only indirectly connected to the frame 4 via the slit-nozzle 12.

The device 2 also comprises the drive unit 10. The drive unit 10 is configured to drive the transfer roller 6 in a rotation direction K of the transfer roller 6, such that the lateral wall 8 continuously passed in the rotation direction K through an angular deformation range 13 fixed to the frame 4 around the axis of rotation 22.

The lateral wall 8 of the transfer roller 6 is elastically deformable in a radial direction R of the transfer roller 6. The lateral wall 8 of the transfer roller 6 can be made of an elastomer plastic, a silicone or any other elastically deformable plastic material. Preferably, the lateral wall 8 of the transfer roller 6 is made of a synthetic, elastically deformable silicone. As a result, the lateral wall 8 can be at least section-wise deformed in radial direction R. The deformation unit 16 is configured to deform the lateral wall 8 in the radial direction R of the transfer roller 6.

The deformation unit 16 is arranged, such that the deformation unit 16 elastically deforms the lateral wall 8 resulting in a respective deformation section 28 of the lateral wall 8. The elastic deformation of the lateral wall 8 does not change abruptly. The deformation section 28 of the lateral wall 8 therefore refers to the section of the wall directly following the exert-position in rotation direction K of the transfer roller 8, wherein the exert-position is the position, where a deformation force is applied by the deformation unit 16 for deforming the lateral wall 8 of the transfer roller 6. As a result of the rotation of the transfer roll 6, the lateral wall 8 passes the deformation unit 16. However, the deformation section 28 shall be understood to be the section of the lateral wall 8 always being directly following the exert-position and/or the deformation unit 16 in rotation direction K. Thus, the deformation section 28 of the lateral wall 8 may refer to the section of the lateral wall 8 being limited by the angular deformation range 13, preferably as indicated in FIG. 2.

As schematically illustrated in FIG. 2, the deformation unit 16 may comprise a pressure roller 38, which is arranged outside of the transfer roller 6. Preferably, the deformation unit 16 is formed by the pressure roller 38. Furthermore, the pressure roller 38 is arranged, such that the pressure roller 38 presses rotatably on the outside contact surface 18 of the lateral wall 8 resulting in a deformation of the lateral wall 8 in the deformation section 28. The deformation is a deformation in radial direction R. As exemplarily shown in FIG. 2, the pressure roller 38 presses on the lateral wall 8 towards the center of the transfer roller 6, such that the deformation section 28 is deformed in radial direction R, such that the mean radius of the deformation section 28 is less than a mean radius of the lateral wall 8. The deformation section 28 forms an intermediate section between the exert-position at the lateral wall 8, where the pressure roller 38 applies a deformation force on the lateral wall 8, and an undeformed section of the lateral wall 8 following the deformation section 28 in the rotation direction K of the transfer roller 6.

As an effect and basically resulting from its intermediate section character, the radius and/or orientation of the deformation section 28 can be predefined by the arrangement of the deformation unit 16, in particular of its pressure roller 38. This radius and/or orientation of the deformation section 28 is at least substantially defined by the deformation caused by the deformation unit 16. A possible variance of the radius of the lateral wall 8 of the transfer roller 6 may therefore have almost no or just a very small influence on the radius and/or orientation of the deformation section 28 of the lateral wall 8.

The muzzle end 14 is preferably formed by the ends of the first and second nozzle-parts 24, 26 facing the lateral wall 8. Generally, the muzzle end 14 of the slit nozzle 12 can be arranged contactless to or in direct contact with the outside contact surface 18 at the deformation section 28 of the lateral wall 8 for dispensing lacquer into respective depressions 20.

In particular if the deformation unit 16 is formed by a pressure roller 38, deformation surface 40 of the deformation unit 16 has direct contact with the lateral wall 8 in order to achieve the desired deformation. The deformation surface 40 of the deformation unit 16 facing the lateral wall 8 and the muzzle end 14 are preferably arranged within an angular range a of less than 40 degree about the rotation axis 22 of the transfer roller 6. As the elastic deformation of the lateral wall 8 does not change abruptly, it has been found in practice that arranging the muzzle end 14 within the angular range a achieves a good lacquer distribution and prevents at the same time the slip-stick effect. Further, a minimum distance between the deformation surface 40 of the deformation unit 16 and the muzzle end 14 is preferably less than 20 mm. Similar effects as described before can be achieved.

According to a preferred embodiment of the device 2 exemplarily illustrated in FIG. 2, the muzzle end 14 of the slit nozzle 12 is spaced apart from the outside contact surface 18 at the deformation section 28 of the lateral wall 8 for dispensing lacquer from the muzzle end 14 into respective depressions 20. The depressions 20 of the lateral wall 8 arranged at the outside contact surface 18 at the second deformation section 28 are therefore filled with lacquer. The transfer roller 6 is driven by the drive unit 10, such that the lacquer is transported via the depressions 20 in rotation direction K such that the outside contact surface 18 with the depressions 20 filled with lacquer roles in direct contact about the work surface 32 for transferring the lacquer to the work surface 32.

Since the deformation unit 16 is connected to the first nozzle-part 24 of the slit nozzle 12, a precise predefined distance and/or space between the muzzle end 14 and the deformation section 28 of the lateral wall 8 can be ensured. This distance and/or space can be configured, such that a desired distribution of lacquer on the lateral wall 8 and a desired thickness of this lacquer can be achieved, while a slip-stick effect can be effectively prevented. This ensures, that the structure, in particular a microstructure, of the depressions 20 at the outside contact surface 18 embosses a predefined lacquer-structure on the work surface 32 of the work piece 34, wherein the predefined lacquer-structure corresponds to the structure of the depressions 20.

The device 2 may also comprise a hardening unit 60. The hardening unit 60 is configured for hardening the lacquer, preferably contactless. The hardening unit 60 can be formed by an UV-light unit. The hardening unit 60 is directly or indirectly connected to the frame 4. Moreover, the hardening unit 60 may be arranged within the interior space 36 formed by the transfer roller 6. For instance, if the hardening unit 60 is formed by an UV-light unit, the lateral wall 8 of the transfer roller 6 may be configured to transmit UV-light-waves. Thus, the lateral wall 8 can be transparent for UV-light. The hardening unit 60 can be arranged, such that UV-light is emitted towards a work surface 32 upon which the lateral wall 8 of the transfer roller 6 can roll. The lacquer may by hardenable via UV-light. Therefore, the device 2 may be configured to control the drive unit 10 and/or the UV-light unit 60, such that lacquer transferred to the work surface 32 is immediately hardened via UV-light emitted by the UV-light unit 60.

As can be seen in FIG. 2, the slit nozzle 12 faces in a nozzle direction N with its muzzle end 14 such that the nozzle direction N results an acute nozzle angle between 5 degree and 60 degree with a straight line (not shown) extending from a center of the transfer roller 6 to the muzzle end 14.

Referring again to FIG. 2, the slit nozzle 12 is schematically illustrated in a preferred embodiment, wherein the slit nozzle 12 comprises the first nozzle-part 24 and a second nozzle-part 26. Both nozzle-parts 24, 26 are connected, in particular releasably connected, with each other. The first nozzle-part 24 protrudes, preferably in the nozzle direction N, beyond the second nozzle-part 26, such that the first nozzle-part 24 is arranged closer to the outside contact surface 18 than the second nozzle-part 26. A fluid channel 30 may be formed between the first nozzle-part 24 and the second nozzle-part 26. The lacquer to be applied to the outside contact surface 18 can be pushed/pressed through the fluid channel 30 so that the lacquer reaches the muzzle end 14 and is dispensed on the outside contact surface 18 of the lateral wall 8. The second nozzle-part 26 can be formed and/or arranged such that a precise application of the lacquer is ensured.

As discussed, the first nozzle-part 24 preferably protrudes beyond the second nozzle-part 26 in the nozzle direction N towards the outside contact surface 18 at the deformation section 28 of the lateral wall 8. The resulting distance between the second nozzle-part 26 and the outside contact surface 18 defines a thickness of an output channel end of the nozzle channel 30 and can therefore at least influence the thickness of the applied lacquer. As a result, a film thickness of the lacquer to be applied on the outside contact surface 18 can be precisely adjusted by the second nozzle-part 26. This can be in particular the case, if the second nozzle-part 26 is displaceable and/or adjustable with respect to the first nozzle-part 24. This may be used to define the thickness of the lacquer film.

As shown in FIG. 2, the slit nozzle 12 is preferably arranged such that a first minimum distance between the muzzle end 14 facing the outside contact surface 18 and this outside contact surface (18) is achieved. This first minimum distance is preferably less than 15 mm, in particular between 0.01 mm and 10 mm. The first minimum distance is preferably the distance in the radial direction R between the outside contact surface 18 and the section of the first nozzle-part 24 which is closest to the outside contact surface 18. The particular small distance according to the first minimum distance ensures a particularly precise and evenly distributed application of the lacquer. At the same time a direct mechanical contact between the outside contact surface 18 of the lateral wall 8 and the first nozzle-part 24 of the slit nozzle 12 is avoided, which prevents wear of the lateral wall 8 of the transfer roller 6 and the slit nozzle 12.

Preferably, the second nozzle-part 26 is spaced apart from the outside contact surface 18 by a second minimum distance between 0.01 mm and 10 mm, in particular between 1 mm and 3 mm. The second minimum distance is preferably the distance in the radial direction R between the outside contact surface 18 and the section of the second nozzle-part 26 which is closest to the outside contact surface 18. This second minimum distance may define the thickness of the lacquer to be applied on the outside contact surface 18. As a further result, the second nozzle-part 26 may be set back by a predefined third distance with respect to the first nozzle-part 24. This third distance may be between 0.01 mm and 5 mm.

It is additionally pointed out that "comprising" does not rule out other elements, and "a" or "an" does not rule out a multiplicity. It is also pointed out that features that have been described with reference to one of the above exemplary embodiments may also be disclosed as in combination with other features of other exemplary embodiments described above. Reference signs in the claims are not to be regarded as restrictive.

While at least one example embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the example embodiment(s). In addition, in this disclosure, the terms "comprise" or "comprising" do not exclude other elements or steps, the terms "a", "an" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A device for a lacquer transfer, comprising:

a frame;

a transfer roller, which is mounted rotatably about an axis of rotation at the frame and has a circumferential lateral wall that is elastically deformable in a radial direction of the transfer roller, an outside contact surface of the lateral wall comprising several depressions;

a drive unit configured to drive the transfer roller in a rotation direction of the transfer roller; and a slit nozzle, which is at least indirectly connected to the frame and comprises:

a first nozzle-part;

a second nozzle-part;

a muzzle end for dispensing lacquer; and a deformation unit, which is attached to the first nozzle-part, such that the lateral wall passes, in the rotation direction, the deformation unit and the muzzle end during a rotation of the transfer roller in the rotation direction and is configured to elastically deform the lateral wall in the radial direction of the transfer roller;

wherein the slit nozzle is arranged, such that the lateral wall of the transfer roller is deformed by the deformation unit in the radial direction resulting in a deformation section of the lateral wall in the rotation direction behind the deformation unit, wherein the muzzle end of the slit nozzle is arranged contactless to or in direct contact with the outside contact surface at the deformation section of the lateral wall for dispensing lacquer into respective depressions, and wherein the transfer roller is configured to roll with the outside contact surface on a work surface of a work piece for transferring the lacquer from the depressions to the work surface of the work piece.

2. The device of claim 1, wherein the slit nozzle comprises a fluid channel that extends to the muzzle end and is formed by and/or extends between the first nozzle-part and the second nozzle-part of the slit nozzle.

3. The device of claim 1, wherein a minimum distance between a deformation surface of the deformation unit facing the lateral wall and the muzzle end is less than 20 mm.

4. The device of claim 3, wherein the deformation surface is arranged within an angular range of less than 40 degree about the axis of rotation.

5. The device of claim 1, wherein the slit nozzle is arranged such that the lateral wall is deformed by the deformation unit by less than 15 mm in the radial direction.

6. The device of claim 1, wherein the deformation unit protrudes at least 1 mm, beyond the slit nozzle towards the outside contact surface of the lateral wall.

7. The device of claim 1, wherein, when the muzzle end of the slit nozzle is arranged contactless to the outside contact surface of the lateral wall, the slit nozzle is arranged such that a first minimum distance between the muzzle end facing the outside contact surface and the outside contact surface is less than 15 mm.

8. The device of claim 1 wherein:

the first nozzle-part is in direct contact with the outside contact surface of the lateral wall; and the second nozzle-part is spaced apart from the outside contact surface.

9. The device of claim 1, wherein the first nozzle-part protrudes beyond the second nozzle-part in a direction towards the outside contact surface of the lateral wall.

10. The device of claim 8, wherein the second nozzle-part is spaced apart from the outside contact surface by a second minimum distance between 0.01 mm and 5 mm, or between 1 mm and 3 mm.

11. The device of claim 9, wherein the second nozzle-part is spaced apart from the outside contact surface by a second minimum distance between 0.01 mm and 5 mm.

12. The device of claim 1, wherein the transfer roller is an inflated transfer roller.

13. The device of claim 1, wherein the deformation unit is configured to deform the lateral wall by between 0.5 mm and 30 mm in the radial direction of the transfer roller.

14. The device of claim 1, wherein the deformation unit comprises a pressure roller, which is configured to press, in a rolling manner, on the lateral wall to deform the lateral wall in the radial direction.

15. The device of claim 1, wherein the deformation unit comprises a gas pressure unit configured to generate positive gas pressure acting contactless on the lateral wall, which causes the lateral wall to deform in the radial direction.

16. The device of claim 1, wherein:

the lateral wall comprises embedded ferromagnetic metal particles; and the deformation unit comprises a controllable electromagnet configured to exert a magnetic force on the metal particles, which causes the lateral wall to deform in the radial direction.

17. The device of claim 1, wherein the deformation unit protrudes at least 3 mm beyond the slit nozzle towards the outside contact surface of the lateral wall.

18. The device of claim 1, wherein, when the muzzle end of the slit nozzle is arranged contactless to the outside contact surface of the lateral wall, the slit nozzle is arranged such that a first minimum distance between the muzzle end facing the outside contact surface and the outside contact surface is between 0.01 mm and 10 mm.

19. The device of claim 9, wherein the second nozzle-part is spaced apart from the outside contact surface by a second minimum distance between 1 mm and 3 mm.

* * * * *